US005085344A

United States Patent [19]

Hintzen

[11] Patent Number: 5,085,344

[45] Date of Patent: Feb. 4, 1992

[54] APPARATUS FOR CLOSING AND/OR REGULATING THE DISCHARGE OR TAPPING OF MOLTEN METAL

[75] Inventor: Ullrich Hintzen, Taunusstein-Watzhahn, Fed. Rep. of Germany

[73] Assignee: Didier-Werke AG, Wiesbaden, Fed. Rep. of Germany

[21] Appl. No.: 618,947

[22] Filed: Nov. 27, 1990

[30] Foreign Application Priority Data

Nov. 28, 1989 [DE] Fed. Rep. of Germany ..... 3939241

[51] Int. Cl.[5] ..... B22D 41/14

[52] U.S. Cl. ..... 222/590; 222/598; 222/599

[58] Field of Search ..... 222/598, 599, 597, 591, 222/590

[56] References Cited

U.S. PATENT DOCUMENTS

| | | | |
|---|---|---|---|
| 3,651,998 | 3/1972 | Rocher | 222/598 |
| 4,905,876 | 3/1990 | Gimpera | 222/598 |
| 4,966,314 | 10/1990 | Brückner et al. | 222/598 |

*Primary Examiner*—S. Kastler

*Attorney, Agent, or Firm*—Wenderoth, Lind & Ponack

[57] ABSTRACT

An apparatus for closing and/or regulating the discharge or tapping of molten metal from a metallurgical vessel includes a ceramic stator member to be fixed to a metallurgical vessel and having a pipe-shaped portion having extending therethrough at least one lateral opening, and a ceramic rotor member having a pipe-shaped portion having extending therethrough at least one lateral opening. The stator and rotor members are coaxially assembled with the pipe-shaped portion of one member fitted over and surrounding the pipe-shaped portion of the other member. The pipe-shaped portions have radially confronting respective cylindrical inner and outer sealing surfaces onto which open the lateral openings, such inner and outer sealing surfaces sealingly engaging to define a primary seal to prevent leakage of molten metal. The stator and rotor members have respective axially confronting end sealing surfaces. The rotor member is axially movable, i.e. loadable, to press the end sealing surface of the rotor member against the end sealing surface of the stator member at a compaction pressure sufficient to form a secondary seal for preventing leakage of molten metal.

21 Claims, 1 Drawing Sheet

APPARATUS FOR CLOSING AND/OR REGULATING THE DISCHARGE OR TAPPING OF MOLTEN METAL

BACKGROUND OF THE INVENTION

The present invention relates to an apparatus for closing and/or regulating the discharge or tapping of molten metal from a metallurgical vessel. More particularly, the present invention relates to such an apparatus including a refractory or ceramic inner pipe-like element having therethrough at least one lateral opening and a refractory or ceramic outer pipe-like element having therethrough at least one lateral opening, one such element being stationary and forming a stator member, and the other element being rotatably movable relative thereto and forming a rotor member. The pipe-like elements are oriented preferably vertically. The elements have respective pipe-shaped portions through which extend the lateral openings and which also define radially confronting respective cylindrical inner and outer sealing surfaces defining a primary seal to prevent leakage of molten metal. The elements also have generally radially extending annular surfaces that confront each other and that extend annularly around the common longitudinal axis of the two pipe-like elements. The present invention also relates to stator and rotor members employable in such an apparatus.

An apparatus of this general type is disclosed in German DE 35 40 202 C1 wherein an outer pipe is rotated with respect to an inner pipe to bring respective openings thereof into and out of alignment to open, close and regulate molten metal tapping or discharge. Cylindrical main sealing surfaces prevent the molten metal from escaping. Accordingly, the gap between the cylindrical sealing surfaces is dimensioned to be so narrow that the molten metal cannot pass therebetween.

Tests have shown however that, when pouring or discharge periods are relatively long, the gap between the main or primary sealing surfaces can expand. The result is that molten metal can pass therebetween when the apparatus is in the closed position, and this of course is very undesirable. A similar apparatus is disclosed in German DE 37 31 600 A1, but such known apparatus also suffers from the same problem.

SUMMARY OF THE INVENTION

With the above discussion in mind, it is an object of the present invention to provide an apparatus of the above described type, but whereby it is possible to overcome the above and other prior art disadvantages.

It is a further object of the present invention to provide such an apparatus whereby it is possible to insure that, when the primary sealing surfaces become worn or when the gap therebetween expands, the apparatus still can be operated to reliably close and/or regulate the discharge or tapping of molten metal without leakage of the molten metal.

It is a yet further object of the present invention to provide stator and rotor members employable in such an apparatus.

These objects are achieved in accordance with the present invention by the provision that each of the stator and rotor members has respective axially confronting end sealing surfaces that annularly surround the common coaxial axes of the two members, and whereby the rotor member is axially movable, at least when the primary seal between the primary cylindrical sealing surfaces of the two members will not prevent leakage of the molten metal, to press the end sealing surface of the rotor member against the end sealing surface of the stator member at a pressure sufficient to form a secondary seal therebetween that will reliably prevent leakage of the molten metal.

By the above features of the present invention it is possible to ensure that the apparatus has a longer and more reliable operating life, since even when the primary seal defined between the cylindrical sealing surfaces n longer is capable of preventing molten metal leakage, the rotor member can be axially moved relative to the stator member to create therebetween a secondary seal operable to reliably prevent leakage of the molten metal. Thereby it is possible to avoid the danger of molten metal breakthrough, and it also is possible to continue use of the apparatus until it can be conveniently replaced or repaired.

It particularly is contemplated that the rotor be axially movable when the lateral opening or openings of the rotor member are out of alignment and communication with the lateral opening or openings of the stator member. This makes it possible to ensure the prevention of molten metal leakage when the apparatus is in its closed position. In accordance with a further feature of the present invention, the rotor member is axially movable to press the end sealing surface thereof against the end sealing surface of the stator member at a pressure of from 0.1 to 10 bar, and at any rate at a pressure higher than the pressure of the molten metal in the metallurgical vessel, i.e. the hydrostatic pressure. One skilled in the art readily would understand the pressures that would be necessary to achieve the functioning of the present invention in a particular installation.

In accordance with a yet further feature of the present invention, each member includes a pipe-shaped portion through which extend the respective lateral opening and which is defined by the respective cylindrical sealing surface and also by respective first and second axially spaced end sealing surfaces, with the cylindrical sealing surface extending between the respective first and second end sealing surfaces. The first and second end sealing surfaces of one member axially confront respective first and second end sealing surfaces of the other member. By at least slight axial movement of the rotor member toward the stator member, the first and second end sealing surfaces of the rotor member press against the respective first and second end sealing surfaces of the stator member at a force or compaction sufficient to withstand the pressure of the molten metal and to prevent molten metal leakage therebetween. Thereby, there are defined two axially spaced secondary seals on opposite axial ends or sides of the lateral openings. The first and second end sealing surfaces of each member extend in opposite radial directions from their respective cylindrical surface thereof. The stator member can be the outer member and the rotor member can be the inner member, or alternatively the rotor member may be the outer member and the stator member may be the inner member.

In accordance with a further feature of the present invention, the end sealing surfaces may be defined by inserts, for example refractory inserts of materials that would be well understand by one skilled in the art to be capable of achieving the function of the present invention. Furthermore, the end sealing surfaces may be planar or non-planar. Particularly, the end sealing surfaces may be conical or may have a profiled configuration in respective radial directions.

BRIEF DESCRIPTIONS OF THE DRAWINGS

Other objects, features and advantages of the present invention will be apparent from the following detailed description of preferred embodiments thereof, with reference to the accompanying drawings, wherein:

FIG. 1 is a sectional view through a bottom portion of a metallurgical vessel having installed therein an apparatus in accordance with a first embodiment of the present invention; and FIG. 2 is a view similar to FIG. 1 but illustrating a second embodiment of the present invention.

DETAILED DESCRIPTION OF THE INVENTION

Figure 1:
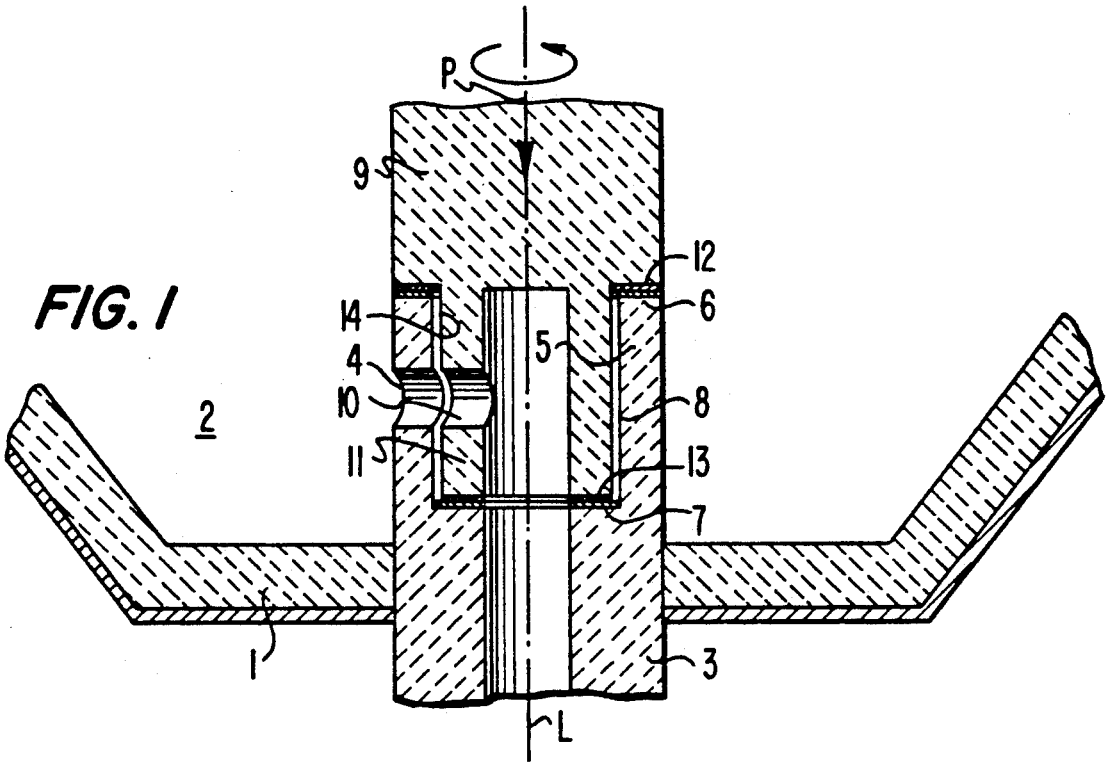

In FIG. 1 there is schematically shown a portion of the bottom of the metallurgical vessel to contain molten metal and including a refractory lining 1 and a conventional outer metal shell or jacket. Fixed to and extending through the bottom of the metallurgical vessel, preferably to extend vertically, is a refractory or ceramic stator member 3 having therethrough a longitudinal passage for the discharge of molten metal and a longitudinal axis L. Rotatably mounted with respect to stator member 3 is a refractory or ceramic rotor member 9 rotatable in the direction of the arrow relative to the stator member. Rotor member 9 has therein, at least partially, a passage in alignment with the passage through the stator member.

Figure 2:
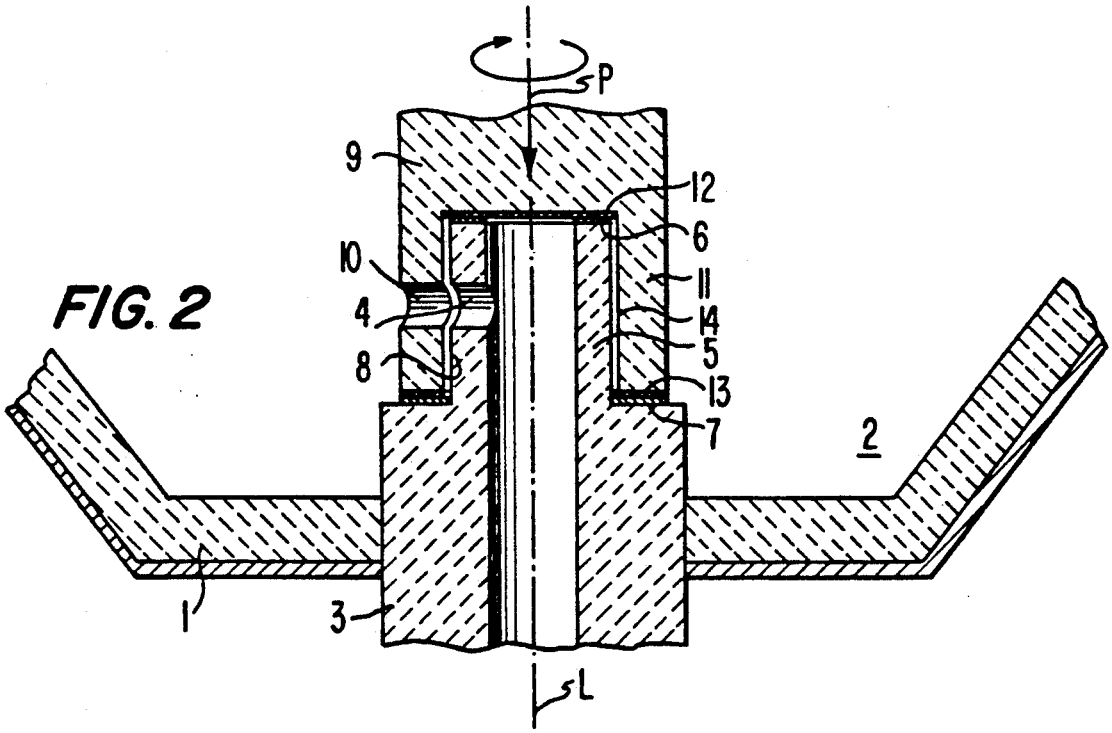

The stator and rotor members have respective pipe-shaped portions 5, 11 coaxial about longitudinal axis L that is common to both members. In other words, rotor member 9 is rotatable relative to stator member 3 about axis L. The two members are coaxially assembled with the pipe-shaped portion of one member fitted over and surrounding the pipe-shaped portion of the other member. In the embodiment of FIG. 1, pipe-shaped portion 5 of stator member 3 fits over pipe-shaped portion 11 of rotor member 9. The arrangement is just the opposite in the embodiment of FIG. 2, i.e. pipe-shaped portion 11 of rotor member 9 fits over pipe-shaped portion 5 of stator member 3.

In both embodiments, the pipe-shaped portions 5, 11 have extending therethrough lateral openings 4, 10 respectively, such lateral openings being at the same level axially of the apparatus. In the illustrated arrangement, each member has therethrough a single opening, but plural openings in one or both of the members could be provided, as would be understood by one skilled in the art. Thus, by rotation of rotor member 9 relative to stator member 3, opening 10 may be brought into and out of alignment with opening 4, thereby to selectively open, regulate and close the discharge or tapping of molten metal from the interior 2 of the metallurgical vessel through the apparatus.

The pipe-shaped portions 5, 11 have respective radially confronting surfaces 8, 14 that are complementary and circular in transverse cross section, preferably cylindrical. These surfaces are dimensioned such that the gap therebetween is so small that melt cannot pass therebetween. Thus, surfaces 8, 14 are primary sealing surfaces that define a primary seal to prevent leakage of molten metal. Particularly, when the apparatus is in the closed position with openings 4, 10 totally out of communication, the primary seal prevents the hydrostatic pressure of the molten metal within the metallurgical vessel from causing leakage of the molten metal through the primary seal.

During the course of time however, the gap between main sealing surfaces 8, 14 can become widened, for example by wear of such surfaces or by expansion of the members. When this occurs, then leakage of molten metal between such surfaces can occur, particularly when the apparatus is in the closed position.

In accordance with the present invention however, when such condition exists, i.e. when the gap between the primary sealing surfaces 8, 14 has expanded to enable molten metal to pass therebetween, it is possible to form secondary seals which will prevent such molten metal leakage. Particularly, each pipe-shaped portion 5, 11 is defined by axially spaced opposite end sealing surfaces. Thus, pipe-shaped portion 5 is in the form of a step defined by axially spaced opposite end sealing surfaces 6, 7. Similarly, pipe-shaped portion 11 is in the form of a step defined by axially spaced opposite end sealing surfaces 12, 13. In accordance with the present invention, the rotor member 9 can be loaded with a compaction pressure in the direction of arrow P sufficient to form secondary seals that will prevent leakage of the molten metal. It is described herein that the rotor member is axially moved toward the stator member to achieve such secondary sealing. By this it is contemplated that only very slight movement actually will occur, sufficient to load rotor member 9 to press the end sealing surfaces 12, 13 thereof against respective end sealing surfaces 6, 7 of the stator member to provide the necessary sealing function. Thus, the confronting end sealing surfaces form secondary seals. It is of course to be understood that it would not be absolutely necessary to require two secondary seals. Rather, the function of the invention could be achieved by providing only a single such secondary seal by confronting end sealing surfaces, for example the upper confronting end sealing surfaces or the lower confronting end sealing surfaces. The actual structure or means to achieve this axial compaction is not shown. One skilled in the art however readily would understand various structures and devices that could be employed to achieve such axial loading and compaction to result in the function of the present invention, i.e. the creation of one or more secondary seals sufficient to prevent molten metal leakage in a given installation.

The compaction pressure always will be greater than the pressure Ds of the melt, i.e. hydrostatic pressure, that is a function of the molten metal level h. Thus, the pressure of the molten metal will be:

$$Ds = h \times Rs \times g$$

where Rs is the density of the melt and g is acceleration due to gravity. It is contemplated that suitable compaction pressures will range from 0.1 bar to 10 bar.

End sealing surfaces 6, 7, 12, 13 can be actual end surfaces of the members 3, 9. Such end surfaces thus can be made of the same material as members 3, 9. However, as illustrated in the drawings it also is possible to provide inserts to define end sealing surfaces 6, 7, 12, 13. Such inserts can be made of suitable materials as would be understood by one skilled in the art. It particularly is contemplated that such inserts could be formed or oxide ceramic materials such as $Al_2O_3$ of $ZrO_2$. Such inserts also could be made of boron nitrite and/or graphite.

The confronting end sealing surfaces 6, 12 and/or 7, 13 do not have to be pushed continuously against each other by the compaction pressure required for sealing. It is sufficient if such end sealing surfaces are subjected to such compaction pressure only if the primary sealing surfaces 8, 14 themselves no longer are adequate to perform the primary sealing function. In such case it of course would be necessary to first determine the inadequacy of the primary seal. To avoid the necessity for such detection, the rotor member 9 always can be loaded with the compaction pressure when the rotor member 9 is in its closed position. It would not be advantageous to load the rotor member 9 with the compaction pressure when the rotor member is being rotated, since the compaction pressure then would make rotation more difficult and the end sealing surfaces would be stressed upon such rotation.

In the embodiments illustrated the end sealing surfaces all are planar and extend radially of common axis L. Such surfaces however also could be non-planar, for example conical. Also, such non-planar surfaces could be radially profiled to form a labyrinth configuration that would further impede leakage of the molten metal.

Although the present invention has been described and illustrated with respect to preferred embodiments thereof, it is to be understood that various modifications and changes could be made to the specifically described and illustrated features without departing from the scope of the present invention. For example, whereas the rotor is shown as being within the interior of the metallurgical vessel and operable from above, it is possible that the rotor member could be inserted from below through the metallurgical vessel and operable from below. Other possible modifications as would be understood by one skilled in the art also are included within the scope of the present invention.

We claim:

1. An apparatus for closing and/or regulating the discharge or tapping of molten metal from a metallurgical vessel, said apparatus comprising:

a ceramic stator member to be fixed to a metallurgical vessel and having a pipe-shaped portion having extending therethrough at least one lateral opening;

a ceramic rotor member having a pipe-shaped portion having extending therethrough at least one lateral opening;

said stator and rotor members being coaxially assembled with said pipe-shaped portion of a first of said members being fitted over and surrounding said pipe-shaped portion of a second of said members and with said lateral openings of said first and second members located at the same position axially of said members, whereby said rotor member is rotatable relative to said stator member to bring said lateral openings thereof into and out of alignment;

said pipe-shaped portions of said first and second members having radially confronting respective cylindrical inner and outer sealing surfaces onto which open said respective lateral openings, said inner and outer sealing surfaces sealingly engaging to define a primary seal to prevent leakage of molten metal;

whereby during use said inner and outer sealing surfaces may become worn or expand, such that said primary seal would not prevent leakage of molten metal;

said stator and rotor members having respective axially confronting end sealing surfaces annularly surrounding the common coaxial axis of said members; and said rotor member being axially movable, at least when said primary seal will not prevent leakage of molten metal, to press end sealing surface of said rotor member against said end sealing surface of said stator member at a pressure sufficient to form secondary seal means for preventing leakage of molten metal.

2. An apparatus as claimed in claim 1, wherein said rotor member is axially movable only when said lateral opening of said rotor member is not in communication with said lateral opening of said stator member.

3. An apparatus as claimed in claim 1, wherein said rotor member is axially movable to press said end sealing surface thereof against said end sealing surface of said stator member at a pressure of from 0.1 to 10 bar.

4. An apparatus as claimed in claim 1, wherein said rotor member is axially movable to press said end sealing surface thereof against said end sealing surface of said stator member at a pressure higher than the pressure of the molten metal in the metallurgical vessel.

5. An apparatus as claimed in claim 1, wherein each said pipe-shaped portion is defined by respective first and second axially spaced said end sealing surfaces, with said cylindrical inner and outer sealing surfaces of said first and second members extending between the respective said first and second end sealing surfaces.

6. An apparatus as claimed in claim 5, wherein said first and second end sealing surfaces of said first member axially confront respective first and second end sealing surfaces of said second member.

7. An apparatus as claimed in claim 6, wherein said rotor member is axially movable to press said first and second end sealing surfaces thereof against respective first and second end sealing surfaces of said stator member, thereby defining two axially spaced secondary seals on opposite axial sides of said lateral openings.

8. An apparatus as claimed in claim 6, wherein said first and second end sealing surfaces of each said member extend in opposite radial directions from the respective said cylindrical sealing surface thereof.

9. An apparatus as claimed in claim 1, wherein said stator member is said first member, and said rotor member is said second member.

10. An apparatus as claimed in claim 1, wherein said rotor member is said first member, and said stator member is said second member.

11. An apparatus as claimed in claim 1, wherein said end sealing surfaces are defined by refractory inserts.

12. An apparatus as claimed in claim 1, wherein said end sealing surfaces are planar.

13. An apparatus as claimed in claim 1, wherein said end sealing surfaces are non-planar.

14. An apparatus as claimed in claim 1, wherein said end sealing surfaces are radially profiled.

15. An apparatus as claimed in claim 1, further comprising means, operatively connected to said rotor member, for selectively moving said rotor member axially of said stator member and thereby for selectively pressing said end sealing surface of said rotor member against said end sealing surface of said stator member and forming said secondary seal means.

16. In a method for closing and/or regulating the discharge or tapping of molten metal from a metallurgical vessel by means of an apparatus comprising a ceramic stator member fixed to said metallurgical vessel and having a pipe-shaped portion having extending therethrough at least one lateral opening, a ceramic rotor member having a pipe-shaped portion having extending therethrough at least one lateral opening, said stator and rotor members being coaxially assembled with said pipe-shaped portion of a first of said members being fitted over and surrounding said pip-shaped portion of a second of said members and with said lateral openings of said first and second members located at the same position axially of said members, said closing and/or regulating method including selectively rotating said rotor member relative to said stator member to bring said lateral openings thereof into and out of alignment, while preventing leakage of molten metal between said members by means of a primary seal defined by sealingly engaging and radially confronting respective cylindrical inner and outer sealing surfaces of said pipe-shaped portions of said first and second members, with said lateral openings opening onto respective said cylindrical surfaces, whereby during use said inner and outer sealing surfaces may become worn or expand, such that said primary seal will not prevent leakage of molten metal, the improvement comprising ensuring the prevention of leakage of molten metal between said members, at least when said primary seal will not prevent such leakage, said ensuring comprising:

providing said stator and rotor members with respective axially confronting end sealing surfaces annularly surrounding the common coaxial axis of said members; and axially moving said rotor member toward said stator member, at least when said primary seal will not prevent leakage of molten metal, and thereby pressing said end sealing surface of said rotor member against said end sealing surface of said stator member at a pressure sufficient to form secondary seal means preventing leakage of molten metal between said members.

17. The improvement claimed in claim 16, comprising axially moving said rotor member only when said lateral opening of said rotor member is not in communication with said lateral opening of said stator member.

18. The improvement claimed in claim 16, comprising axially moving said rotor member to press said end sealing surface thereof against said end sealing surface of said stator member at a pressure of from 0.1 to 10 bar.

19. The improvement claimed in claim 16, comprising axially moving said rotor member to press said end sealing surface thereof against said end sealing surface of said stator member at a pressure higher than the pressure of the molten metal in the metallurgical vessel.

20. The improvement claimed in claim 16, comprising providing each said pipe-shaped portion to be defined by respective first and second axially spaced said end sealing surfaces, with said cylindrical inner and outer sealing surfaces of said first and second members extending between the respective said first and second end sealing surfaces, and with said first and second end sealing surfaces of said first member axially confronting respective first and second end sealing surfaces of said second member, and axially moving said rotor member to press said first and second end sealing surfaces thereof against respective first and second end sealing surfaces of said stator member, thereby defining two axially spaced secondary seals on opposite axial sides of said lateral openings.

21. The improvement claimed in claim 16, comprising defining said end sealing surfaces by refractory inserts.

* * * * *